US011045968B2

(12) United States Patent
Koike

(10) Patent No.: US 11,045,968 B2
(45) Date of Patent: Jun. 29, 2021

(54) KNIFE ASSEMBLY

(71) Applicant: Meinan Machinery Works, Inc., Obu (JP)

(72) Inventor: Masaru Koike, Obu (JP)

(73) Assignee: MEINAN MACHINERY WORKS, INC., Obu (JP)

( * ) Notice: Subject to any disclaimer, the term of this patent is extended or adjusted under 35 U.S.C. 154(b) by 267 days.

(21) Appl. No.: 15/865,545

(22) Filed: Jan. 9, 2018

(65) Prior Publication Data

US 2018/0215065 A1 Aug. 2, 2018

(30) Foreign Application Priority Data

Jan. 27, 2017 (JP) ..... 2017-013529
Jun. 22, 2017 (JP) ..... 2017-121806
Jul. 4, 2017 (JP) ..... 2017-130951

(51) Int. Cl.
*B26D 7/26* (2006.01)
*B27L 5/02* (2006.01)
(Continued)

(52) U.S. Cl.
CPC ..... *B26D 7/2628* (2013.01); *B26D 7/2614* (2013.01); *B27L 5/02* (2013.01);
(Continued)

(58) Field of Classification Search
CPC ..... B26D 7/2628; B26D 7/2614; B26D 1/02; B26D 3/28; B27L 5/02; B27L 5/025;
(Continued)

(56) References Cited

U.S. PATENT DOCUMENTS 1,772,726 A * 8/1930 Mengel ..... B27L 5/00 144/212
1,857,446 A * 5/1932 Elder ..... B27L 5/02 144/212

(Continued)

FOREIGN PATENT DOCUMENTS

JP S54-84698 A 7/1978
JP 54-84698 A * 6/1979

(Continued)

OTHER PUBLICATIONS

JP S54 084698 A MT, Machine translation of JP S54 084698 A, Jul. 1979 (Year: 2019).*

(Continued)

*Primary Examiner* — Shelley M Self
*Assistant Examiner* — Fred C Hammers
(74) *Attorney, Agent, or Firm* — Locke Lord LLP

(57) ABSTRACT

A knife assembly for use in a veneer cutting machine such as a rotary veneer lathe and a veneer slicer includes a knife blade, a knife blade holder and a knife adjusting bolt with a lock nut. The knife blade holder includes a holder block having formed therethrough a threaded hole through which the knife adjusting bolt is adjustably inserted. The holder block has a first support surface that is in supporting contact with a part of one surface of the knife blade on the side thereof where a bevel face of the knife blade is formed and a second support surface that is in supporting contact with a part of a base end surface located opposite from and extending parallel to a cutting edge of the knife blade.

19 Claims, 12 Drawing Sheets

(51) Int. Cl.
*B26D 3/28* (2006.01)
*B26D 1/02* (2006.01)

(52) U.S. Cl.
CPC ..... *B27L 5/025* (2013.01); *B26D 1/02* (2013.01); *B26D 3/28* (2013.01)

(58) Field of Classification Search
CPC ..... B27L 5/00; B27L 5/006; B27G 13/00; B27G 13/005; B27G 13/02; B27G 13/04; B27G 13/06; B27G 13/08; B27G 13/10; B27G 13/12; B02C 18/143; B27C 1/002; B27C 1/10
USPC .... 144/212, 114.1, 115, 120, 121, 122, 132, 144/142, 155, 156, 162.1, 166, 175, 182, 144/185; 241/92, 294
See application file for complete search history.

(56) References Cited

U.S. PATENT DOCUMENTS 3,866,642 A * 2/1975 Walser ..... B27L 5/00 144/212
5,385,185 A * 1/1995 Calvert ..... B27G 1/00 144/211
5,564,967 A * 10/1996 Jorgensen ..... B27L 11/005 144/364
5,630,454 A * 5/1997 Koike ..... B27L 5/02 144/212
9,168,672 B2 * 10/2015 Hinchliff ..... B27G 13/10
2005/0139287 A1 * 6/2005 Koike ..... B27L 5/025 144/332

FOREIGN PATENT DOCUMENTS

JP 5846989 * 7/1979
JP 54084698 * 7/1979

OTHER PUBLICATIONS

JP S54 084698 A MT, Machine translation of JP S54 084698 A, Jul. 1979 (Year: 2019) (Year: 1979).*
Machine translation of JP54-084698, 11 Pages. (Year: 1979).*
JP54084698 Machine translation (Year: 1979).*

* cited by examiner

KNIFE ASSEMBLY

FIELD OF THE INVENTION

The present invention relates to a knife assembly for use in a veneer cutting machine such a rotary veneer lathe and a veneer slicer.

BACKGROUND OF THE INVENTION

Referring to FIG. 11, there is shown in a fragmentary side view of a part of a typical rotary veneer lathe which is disclosed in the Japanese Patent No. 3,689,132. Specifically, the drawing shows a knife blade 57 that is fixedly mounted on a knife carriage 55 of a rotary veneer lathe that is movable toward a log or a wood block 51 held and rotated by spindles (not shown) for a distance corresponding to the thickness of veneer sheet 53 to be peeled by the veneer lathe for each rotation of the wood block 51. The knife blade 57 has at the tip end thereof a cutting edge 57C that is formed by a surface 57A and a bevel surface 57B of the knife blade 57. The knife blade 57 fixed on the knife carriage 55 and ready for veneer peeling operation need be precisely set so that the cutting edge 57C is positioned at a height corresponding to an imaginary horizontal plane passing through the axis of rotation (not shown) of the wood block 51. If the cutting edge 57C is positioned away from the desired height, the thickness of the veneer sheet 53 cut by such knife blade 57 is varied and, therefore, veneer with a degraded quality is produced.

Continued use of the knife blade 57 for peeling veneer from a rotating wood block 51 causes a wear to the cutting edge 57C, which in turn causes irregular or rough surface on peeled veneer sheet. Such knife blade 57 is removed from the knife carriage 55 and the cutting edge 57C is ground by a grinding machine (not shown) to sharpen the cutting edge 57C. Grinding of the cutting edge 57C means stock removal and that the position of the cutting edge 57C with respect to the blade bottom surface 57D is changed. Specifically, the height of the cutting edge 57C, or the dimension of the knife blade 57 as measured from the bottom surface 57D to the cutting edge 57C, is reduced. For adjustment of the knife blade 57 to position the cutting edge 57C at the above-described desired height when the knife blade 57 is set in the knife carriage 55 as shown in FIG. 11, a plurality of threaded holes 61 (only one hole shown in the drawing) is formed in the bottom of the knife blade 57 at a predetermined spaced distance in the longitudinal direction the knife blade 57 along the cutting edge 57C and an adjusting bolt 59 is screwed in each of the threaded holes 61. In FIGS. 11 and 12, reference symbol P1 shows the knife assembly that includes the knife blade 57, the adjusting bolts 59 screwed in the threaded holes 61 in the bottom of the knife blade 57 and lock nuts 63 that secure the respective adjusting bolts 59 to the knife blade 57.

In such knife assembly P1, the distance between the cutting edge 57C of the knife blade 57 and the top surface 59B of the adjusting bolt head 59A is the knife height in the context of the knife height adjustment. Therefore, the knife height adjustment is made so that the cutting edge 57C of the knife blade 57 of the knife assembly P1 as mounted on the knife carriage 55 coincides with the aforementioned imaginary horizontal plane. For the sake of description, the knife height is indicated by L1 in FIG. 12.

For better understanding of the present invention, the following will describe in detail a procedure for knife height adjustment and mounting of the knife assembly P1 to the knife carriage 55. An adjustment jig 64 is used for the knife height adjustment. Referring to FIG. 12 showing a method for knife height adjustment, the jig 64 includes a base 66 and an upright member 68 that is fixedly mounted in upright position to the base 66. The distance between the top surface 66A of the base 66 and the top surface 68A of the upright member 68 corresponds to the desired knife height L1. Numeral 70 designates a dial gauge of a known structure having a spindle 70A, a gauge head 70B and an indicator 70C. The gauge head 70B is urged by a spring (not shown) to move away from the indicator 70C. The jig 64 further includes a support block 72A that supports the dial gauge 70 and a connection block 72 that is fixed to the top surface 68A of the upright member 68 and to the support block 72A, thus the dial gauge 70 being held in place in the jig. 64. The gauge head 70B is attached to the spindle 70A and movable by being pushed by an object to be measured. Such movement of the gauge head 70B and hence of the spindle 70A is converted into rotation of an indicating needle of the indicator 70C to show the measurement.

In making the knife height adjustment, firstly the gauge head 70B of the dial gauge 70 is set in contact with the top surface 68A of the upright member 68 and the measurement on the dial gauge 70 is read and taken as reference value R. Each adjusting bolt 59 is screwed out previously to such an extent that the distance between the cutting edge 57C of the knife blade 57 and the bolt head surface 59B of the adjusting bolt 59 is sufficiently larger than L1. Subsequently, the gauge head 70B is lifted up by hand to provide a space between the gauge head 70B and the top surface 66A of the base 66 that is large enough for the knife assembly P1 to be placed in upright position in the space. The knife assembly P1 is set in the jig 64 with the adjusting bolt head 59A placed on the top surface 66A of the base 66 and the surface 57A of the knife blade 57 placed against the upright member 68, as shown in FIG. 12. The gauge head 70B is lowered into contact with the cutting edge 57C of the knife blade 57 and the then measurement on the dial gauge 70 is read and taken as Q1. Since the knife assembly P1 is set in the jig 64 with the cutting edge 57C of the knife blade 57 positioned above the top surface 68A of the upright member 68, the measurement Q1 is greater than the measurement R or the value L1. The knife assembly P1 is removed from the jig 64 and the first knife height adjustment is made by screwing in the respective adjusting bolts 59. After such adjustment is over, the knife assembly P1 is set in the jig 64 again and the dial gauge 70 is read. According to the measurement on the dial gauge 70, second knife height adjustment is made by turning the adjusting bolts 59 in either direction as required. Such knife height measurement and adjustment are made repeatedly at different points along the knife edge 57C until the dial gauge reading Q1 at the different points coincides with the reference value R. The knife height measurement at the different points along the cutting edge 57C with use of a single dial gauge such as 70 may be accomplished by moving the knife assembly P1 in the longitudinal direction thereof to change the point of measurement by the single dial gauge 70.

If the measurement Q1 on the dial gauge 70 made when the knife assembly P1 is initially set in the jig 64 is the same as R, it means that the knife height is at L1 or less. Whether the then knife height is the same as L1 or not cannot be determined from the dial gauge reading. In such a case, the adjusting bolts 59 are screwed out so that the cutting edge 57C of the knife blade 57 is positioned slightly above the top surface 68A of the upright member 68 when the knife assembly P1 is set in the jig 64. Subsequently, the above-described procedure for the knife height adjustment, that is performed when the cutting edge 57C of the knife blade 57 is positioned above the top surface 68A of the upright member 68, is repeated until the knife height becomes L1. After the knife height adjustment is over, the adjusting bolts 59 are secured by tightening the lock nuts 63.

The knife assembly P1 thus completed is mounted on the knife carriage 55 as shown in FIG. 11. In the drawing, reference numeral 65 designates a blade back support plate having a curved surface 63A at the top end thereof and fixed to the knife carriage 55 by bolts 67. Reference numeral 55A designates a mounting surface of the knife carriage 55 for receiving the adjusting bolt head 59A of the knife assembly P1. Numeral 69 designates a plurality of knife clamps (only one clamp shown in the drawing) disposed at a spaced distance in the longitudinal direction of the knife blade 57. As shown in FIG. 11, the knife clamp 69 is pivotally supported by a support arm 71 via a bearing 73 mounted in the support arm 71 so that the knife clamp 69 is pivotable about the bearing 73 as indicated by double-headed arrow. The support arm 71 is fixed to a frame of the knife carriage 55. The pivoting movement of each knife clamp 69 is effected by a hydraulic cylinder 75 mounted in the knife carriage 55. Specifically, the hydraulic cylinder 75 has a piston rod 75A and a pusher 75B that is mounted at the piston rod end and engageable with the lower end of the knife clamp 69. Solid line of the knife clamp 69 shows the operative clamping position and phantom line the unclamping or retracted inoperative position of the knife clamp 69, respectively.

In mounting the knife assembly P1 to the knife carriage 55, the knife clamps 69 are pivoted to their inoperative position indicated by phantom line (FIG. 11) by retracting the piston rod 75A of the hydraulic cylinder 75. The knife assembly P1 having the knife blade 57 adjusted properly is lifted and moved to the knife carriage 55 by an in-house lifting equipment such as crane. The knife assembly P1 is set in knife carriage 55 such that the top surface 59A of the adjusting bolt head 59 is placed on the mounting surface 55A of the knife carriage 55 and the surface 57A of the knife blade 57 set against the blade back support plate 65, as shown in FIG. 11. Then, the hydraulic cylinders 75 are operated to extend their piston rods 75A thereby to turn the knife clamps 69 clockwise about the pivot 73 as seen in FIG. 11 to their operative clamping positions indicated by solid line, thus the knife assembly P1 being held down firmly against the blade back support plate 65. Thus, the knife assembly P1 is held securely between the knife clamps 69 and the blade back support plate 65.

FIG. 11 also shows a state in which the wood block 51 is being cut to produce a veneer sheet 63 of a predetermined thickness. As the veneer sheet cutting is continued, the cutting edge 57C of the knife blade 57 is worn gradually and the cutting performance of the knife blade 57 is deteriorated accordingly, which means that the cutting edge 57C of the knife blade 57 need be ground. In such a case, the knife assembly P1 having the worn knife blade 57 is removed from the knife carriage 55 to be replaced with a new knife assembly having a ground knife blade. The knife assembly P1 may be released by retracting the hydraulic cylinders 75 and removed from the knife carriage 55 by using the above-mentioned lifting equipment. The new knife assembly may be mounted onto the knife carriage also by using the lifting equipment. According to a conventional practice, removal, transportation and installation of a knife assembly have been carried out by using lifting equipment or the like because the knife blade is too heavy to carry by hands and hence laborious and dangerous to do so.

In general, handling of a knife assembly such as P1 having a worn knife blade with lifting equipment such as crane involves moving a hook of the equipment to the knife carriage, lowering the hook, engaging the hook with the knife assembly in the knife carriage, lifting the knife assembly from the knife carriage and moving the knife assembly to any suitable place for storage. Furthermore, handling of a knife assembly having a ground knife blade involves moving the hook of the equipment to the knife assembly, lowering the hook, engaging the hook with the knife assembly, lifting the knife assembly and moving and lowering the knife assembly to the knife carriage. As mentioned above, a knife blade is generally extremely heavy, weighing hundreds of kilograms. If the above operations to handle a heavy knife assembly is performed quickly in order to increase the working efficiency, it may invite a hazardous situation in that the moving knife blade may be brought into contact with maintenance personnel or nearby equipment. In order to avoid the hazardous situation, handling of the knife assembly in removing the knife assembly having a worn knife blade from the knife carriage and installing a new knife assembly with a ground knife blade onto the knife carriage need be carried out slowly and with great care spending a long time, which affects the working efficiency and hence the productivity of veneer peeling by a veneer rotary lathe.

If the knife blade such as 67 is made thinner to reduce its weight, the above operations in removing and installing the knife assembly may be carried out by hand, so that the time spent for the handling of the knife assembly may be shortened as compared with a case in which the lifting equipment is used for movement of the knife assembly. It is be to be noted that the position of the adjusting bolt screwed in the threaded hole must not be changed relative to the knife blade. However, a knife blade which is made thinner reduces its effective thickness at position where the adjusting bolt receiving holes are formed and, therefore, the knife blade tend to be deformed or displaced relative to the adjusting bolts under the influence of external force acting on the knife blade during veneer cutting by the veneer lathe. Consequently, the dimension between the top surface of the adjusting bolt head and the cutting edge of the knife blade, which correspond to the desired knife height, may be altered, with the result that veneer of the required quality may not be produced.

The present invention provides a knife assembly including a knife blade, a knife blade holder that is fixed to the knife blade at a position adjacent to the base end of the knife blade, and an adjusting bolt that is screwed through a threaded hole formed in the knife holder.

SUMMARY OF THE INVENTION

The present invention, which has been made in light of the above-identified problems, is directed to providing a knife assembly the knife blade of which can be made thinner and hence less heavy than heretofore and that maintains proper relative position between the knife blade and the adjusting bolt and also permits easy handling of the knife assembly.

In accordance with the present invention, there is provided a knife assembly that is adapted for use in a veneer cutting machine such as a rotary veneer lathe and a veneer slicer and permits the use of a knife blade which is thinner and hence less heavy than heretofore. The knife assembly includes a knife blade, at least one knife blade holder that is fixed to the knife blade and a knife adjusting bolt with a lock nut. The knife blade has first and second surface across the thickness of the knife blade, a bevel surface formed on the first blade surface side, a cutting edge formed by the bevel surface and the second blade surface and a base end surface located opposite from and extending parallel to the cutting edge. The knife holder includes a holder block having a first support surface that is in contact with and supports a part of the first blade surface and a second support surface that is in contact with and supports a part of the base end surface of the knife blade. The holder block has formed therethrough in height direction of the knife blade a threaded hole through which the knife adjusting bolt is adjustably inserted.

According to one aspect of the invention, the knife assembly includes a plurality of knife blade holders each including a holder block of an L-shape having a vertical portion and a horizontal portion in cross section taken perpendicularly to the knife blade thickness, in which the first support surface supporting the first blade surface is formed in the vertical portion and the second support surface supporting the base end surface of the knife blade is formed in the horizontal portion of the L-shape of the holder block, respectively. The knife holder is fixed to the knife blade by means of a bolt inserted through a hole formed through the holder block and screwed in a threaded hole formed through the knife blade.

According to another aspect of the invention, the knife blade has formed in the bottom thereof a rectangular recess that is recessed from the base end surface toward the cutting edge and having a recessed bottom surface extending parallel to the base end surface. The holder block is generally of a cuboid shape having formed therein a void portion in the form of a recess of a cuboid shape having three adjoining surfaces. The holder block further has a solid portion located adjoining to the void portion and having at the top thereof a surface that extends parallel to the base end surface of the knife blade. The solid portion of the holder block has a shape that is complementary to that of the rectangular recess formed in the knife blade. The knife holder is fixed to the knife blade with the solid portion of the holder block fitted in the complementary shaped rectangular recess of the knife blade, in which one surface of the three adjoining surfaces of the cuboid-shaped recess of the holder block is in contact with a part of the first blade surface and the surface of the solid portion of the holder block is in contact with the bottom surface of the rectangular recess of the knife blade, or alternatively another surface of the three adjoining surfaces of the cuboid-shaped recess is in contact with the a part of the base end surface of the knife blade.

DETAILED DESCRIPTION OF THE EMBODIMENTS

The following will describe the first embodiment of a knife assembly according to the present invention with reference to FIGS. 1 through 6. It is noted that the knife assembly according to the embodiments of the invention is of a type that is applicable to a rotary veneer lathe.

Figure 1:
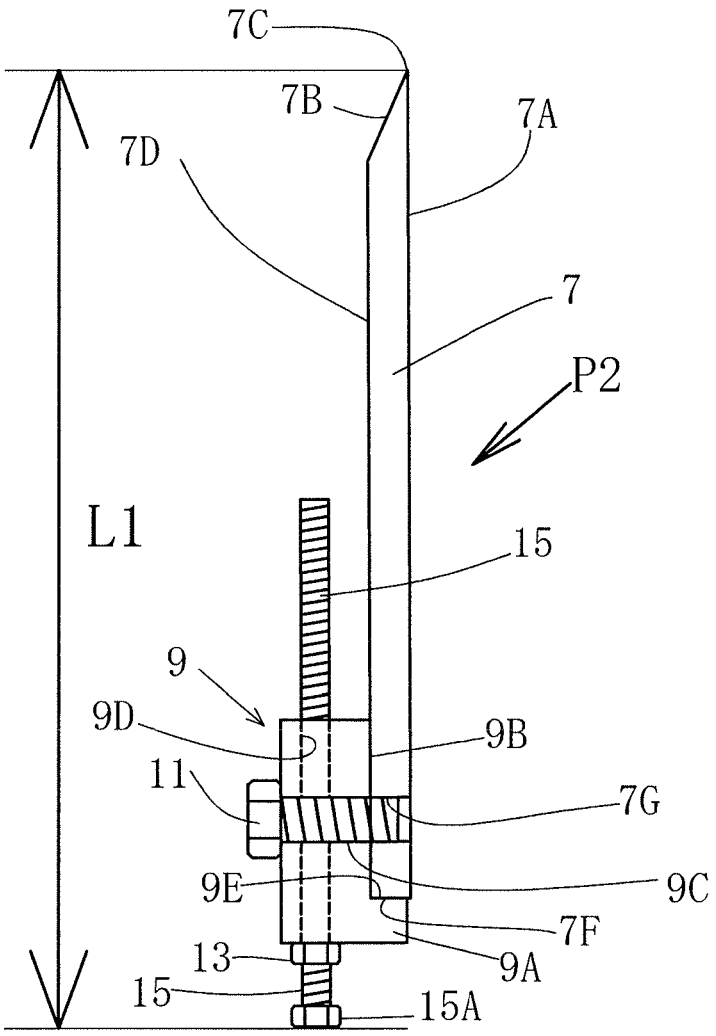
FIG. 1 is side view of a knife assembly for use in a rotary veneer lathe according to a first embodiment of the present invention.

Referring to FIG. 1, there is shown a knife assembly P2 according to the first embodiment of the present invention. The knife assembly P2 includes a knife blade 7, a plurality of knife blade holders 9 (only one holder shown in the drawing) and a knife height adjusting bolt 15 with a lock nut 13. The knife blade 7 has a first surface 7D and a second surface 7A formed across the thickness of the knife blade 7 and extending parallel to each other, a bevel surface 7B formed on the first surface 7D side of the knife blade 7, a cutting edge 7C formed by the second surface 7A and the bevel surface 7B, and a base end surface 7F extending opposite from and parallel to the cutting edge 7C. The knife blade 7 has a length or the dimension as measured along the cutting edge 7C. In the description of the embodiments of the present invention, the dimension of the knife blade 7 as measured from the blade base end surface 7F to the cutting edge 7C will be referred to as the height in association with the knife height adjustment described earlier. The knife blade 7 has formed therethrough in the thickness direction thereof a plurality of threaded holes 7G (only one hole shown in the drawing) at positions adjacent to the base end surface 7F and spaced at a predetermined distance along the longitudinal direction of the knife blade 7.

The knife blade holders 9 are disposed on the first blade surface 7D side of the knife blade 7 at positions where the threaded holes 7G are formed through the knife blade 7. Each knife blade holder 9 includes a holder block 9A having an L-shape as seen in the side view of FIG. 1 and a fixing bolt 11. The holder block 9A has a vertical or first support surface 9B that is formed in the vertical portion of the L-shape of the holder block 9A and in contact with and supports a lower part of the first surface 7D of the knife blade 7 and a horizontal or second support surface 9E that is formed in the horizontal portion of the L-shaped holder block 9A and in contact with and supports a part of the base end surface 7F of the knife blade 7. As shown in FIG. 1, the first support surface 9B and the second support surface 9E of the holder block 9A and the first surface 7D and the base end surface 7F of the knife blade 7 are formed flat, so that the above-mentioned contacts are provided by surface-to-surface contact. The holder block 9A has therethrough a hole 9C formed extending perpendicularly to the first support surface 9B at such a position that the hole 9C is coaxial with its corresponding threaded hole 7G in the knife blade 7. The knife blade holder 9 is fixed firmly to the knife blade 7 by the fixing bolt 11 that is inserted through the hole 9C in the holder block 9A and screwed into the threaded hole 7G in the knife blade 7. The fixing bolt 11 has such a length that the end of the fixing bolt 11 opposite from the bolt head is positioned within the knife blade 7 without extending out from the blade second surface 7A.

Figure 2:
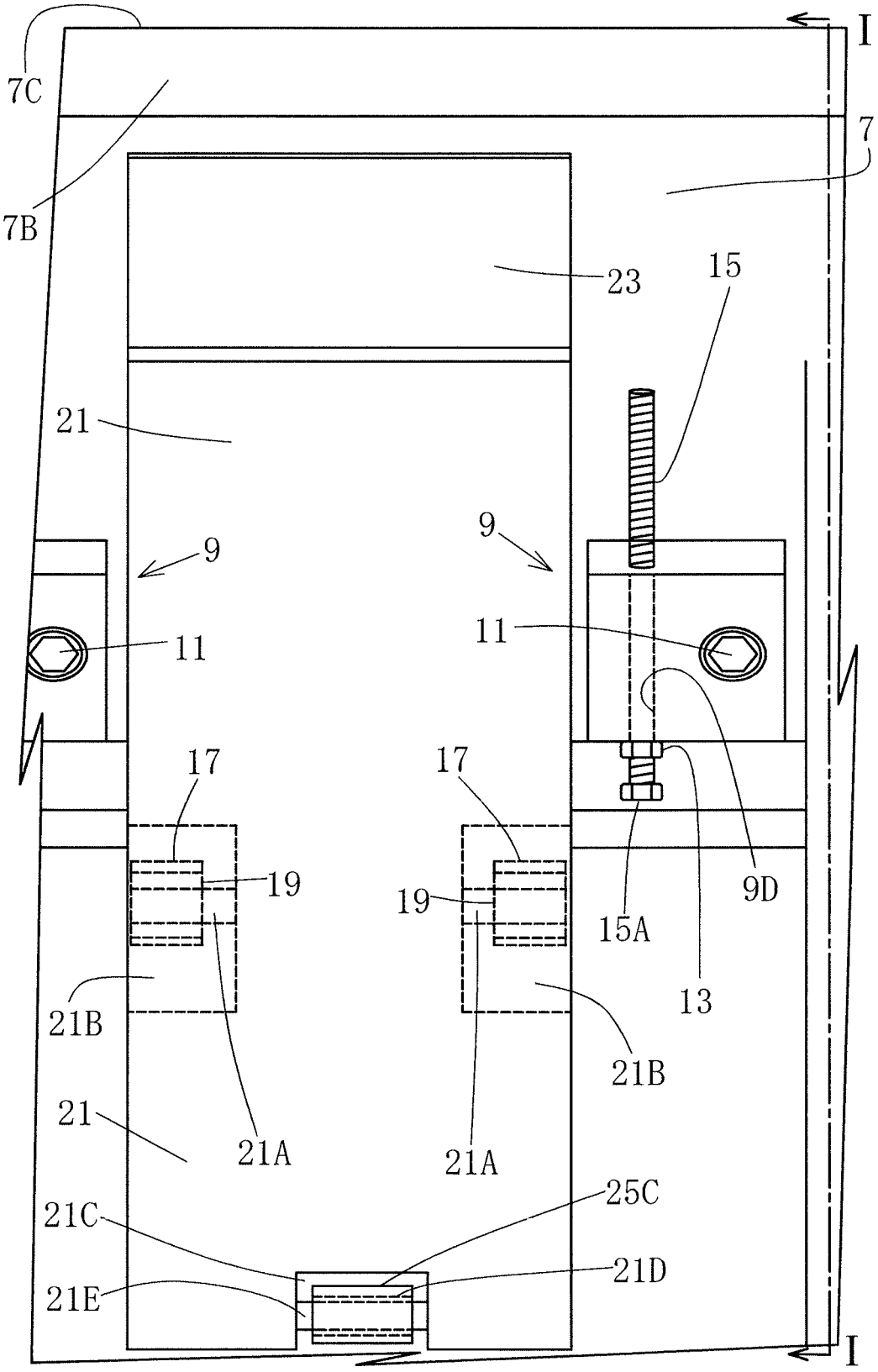
FIG. 2 is a fragmentary front view of the knife assembly of FIG. 1 as mounted on a knife carriage of the rotary veneer lathe.

Referring to FIGS. 1 and 2, the holder block 9A has therethrough a threaded hole 9D that is formed extending vertically or in perpendicular relation to the hole 9C formed through the holder block 9A. The aforementioned knife height adjusting bolt 15 is screwed through the threaded hole 9E of the holder block 9A and secured by the lock nut 13 that is screwed on the adjusting bolt 5 against the bottom of the holder block 9A. Specifically, the adjusting bolt 15 is screwed through the threaded hole 9E and secured by the lock nut 13 with a part of the adjusting bolt 15 of a certain length extending out from the bottom of the holder block 9A so that the knife assembly P2 has the desired knife height L1.

Before mounting the knife assembly P2 to a knife carriage 1 (FIG. 3), the adjusting bolt 15 is screwed in or out of the holder block 9A for the knife height adjustment so that the distance between the cutting edge 7C and the top surface of the adjusting bolt head 15A becomes the desired knife height L1, as shown in FIG. 1. Because this knife height adjustment is performed substantially in the same manner as described with reference to FIG. 12, detailed description of the adjustment will not be reiterated. After the knife height adjustment is over, the position of each adjusting bolt 15 relative to the knife blade holder 9 may be secured by tightening the lock nut 13. In so doing, the knife assembly P2 is made ready for installation onto the knife carriage 1.

Figure 3:
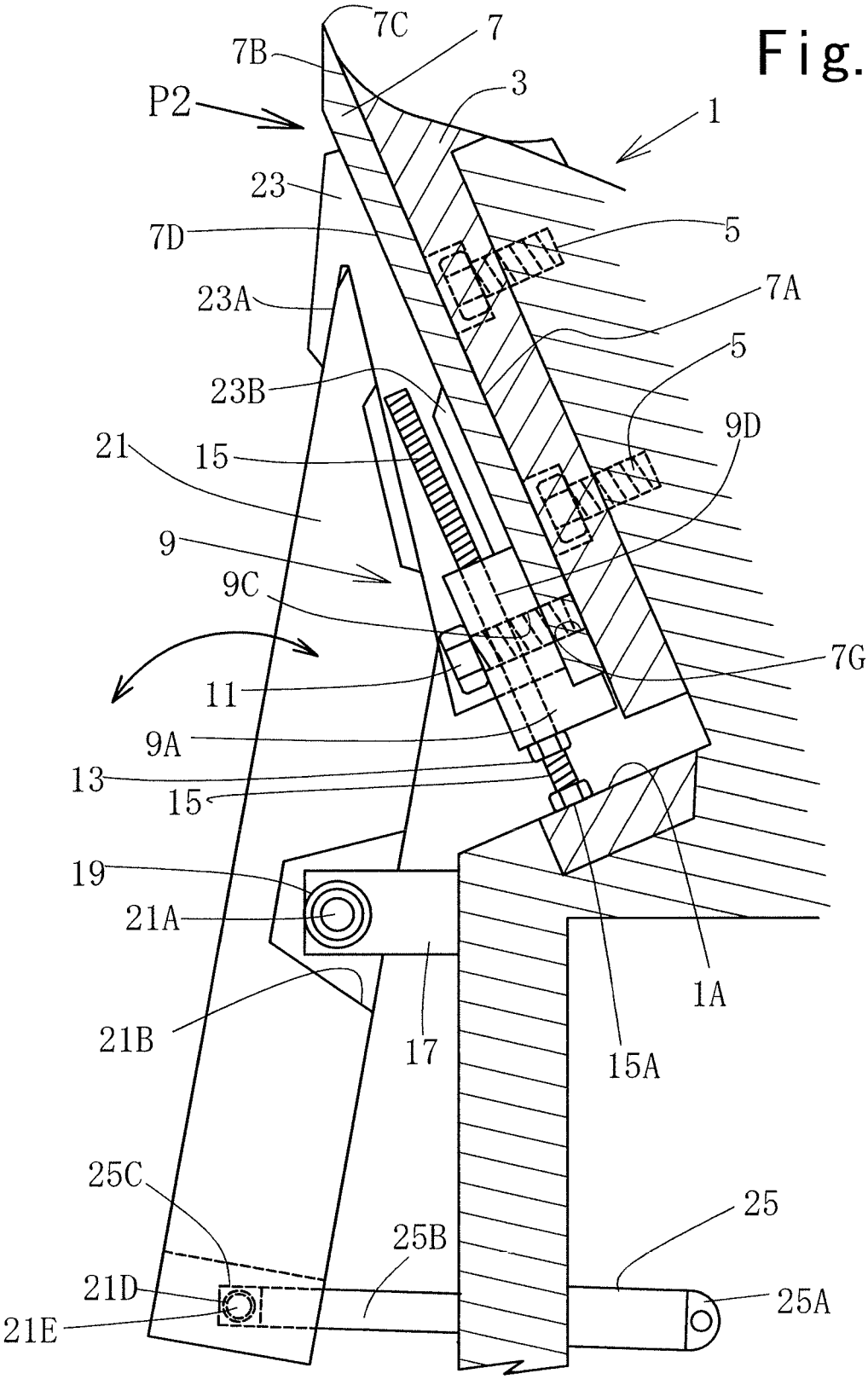
FIG. 3 is a fragmentary partially-sectional side view taken along line I-I and viewed in arrow direction of FIG. 2.

Referring to FIGS. 2 and 3, the knife carriage 1 has a plurality of blade clamps 21 (only one clamp shown in the drawings). The blade clamps 21 are disposed on the front side of the knife carriage 1 at a predetermined spaced distance in the longitudinal direction of the knife blade 7 for clamping or holding down the knife blade 7 against a blade back support plate 3 that is fixed to the knife carriage 1 by bolts 5 and supports the knife blade 7 from behind the knife blade 7. As shown in FIG. 2, each blade clamp 21 is located between any two adjacent knife blade holders 9. The knife carriage 1 has a plurality of blade clamp support arms 17 projecting horizontally from the knife carriage 1 and spaced in the longitudinal direction of the knife blade 7. Each blade clamp 21 has formed therein and on opposite sides thereof a pair of recesses 21B and has a pair of shafts 21A disposed within the recesses 21A and extending in the longitudinal direction of the knife blade 7. A bearing 19 is mounted on each shaft 21A. Each blade clamp 21 is pivotally supported by two adjacent knife clamp support arm 17 by way of the bearings 19 and the shafts 21A. The provision of the recesses 21B in the blade clamp 21 permits the pivoting motion of the blade clamp 21 about the shafts 21A without interfering with the knife clamp support arm 17.

Additionally, each blade clamp 21 has formed at the center in the lower end thereof a recess 21C to receive therein one end of a piston rod 25B of a hydraulic cylinder 25 which will be described later. Specifically, a shaft 21E is fixedly mounted to the knife clamp 21 extending in the longitudinal direction of the knife blade 7 in the recess 21C of the blade clamp 21 and the piston rod 25B of the hydraulic cylinder 25 is pivotally connected at the one end thereof to the shaft 21E by way of a connection member 25C provided at the one end of the piston rod 25B and a bearing 21D mounted on the shaft 21E. The hydraulic cylinder 25 shown in FIG. 3 is provided for each blade clamp 21 and connected pivotally at the proximal end 25A thereof to a frame of the knife carriage 1. The hydraulic cylinder 25 has a hydraulic pump motor (not shown) and a piping (not shown either). The blade clamp 21 is driven to rotate about the shaft 21A by its corresponding hydraulic cylinder 25. The hydraulic cylinder 25 is operable in response to a signal generated by manual operation of a control by a lathe operator.

Referring again to FIGS. 2 and 3, the knife carriage 1 has a plurality of auxiliary blade clamps 23, each disposed between the knife blade 7 and its corresponding blade clamp 21. As shown in FIG. 3, the auxiliary blade clamp 23 has therein adjacently to the upper end thereof a recess 23A having a shape that is complementary to the shape of the upper end portion of the blade clamp 21 so as to receive therein the upper end portion of the blade clamp 21 thereby to position the blade clamp 21. Though not shown in the drawings, the auxiliary blade clamp 23 has therein on the side thereof that is adjacent to the blade clamp 21 a plurality of permanent magnets to fix the blade clamp 21 against the auxiliary blade clamp 23 by magnetic attraction, as shown in FIG. 3. As with the blade clamp 21, each auxiliary blade clamp 23 is positioned between any two adjacent knife blade holders 9 of the knife assembly P2 mounted in the knife carriage 1. As shown in FIG. 3, part of the surface of the auxiliary blade clamp 23 facing the knife blade 7 is recessed at 25B toward the blade clamp 21 to secure tight contact between the auxiliary blade clamp 23 and the knife blade 7. As shown in FIG. 3, the knife carriage 1 has a mounting surface 1A that is provided by the top surface of a replaceable insert block which is made of a hard material and removably inserted in a groove formed in the knife carriage 1.

Figure 4:
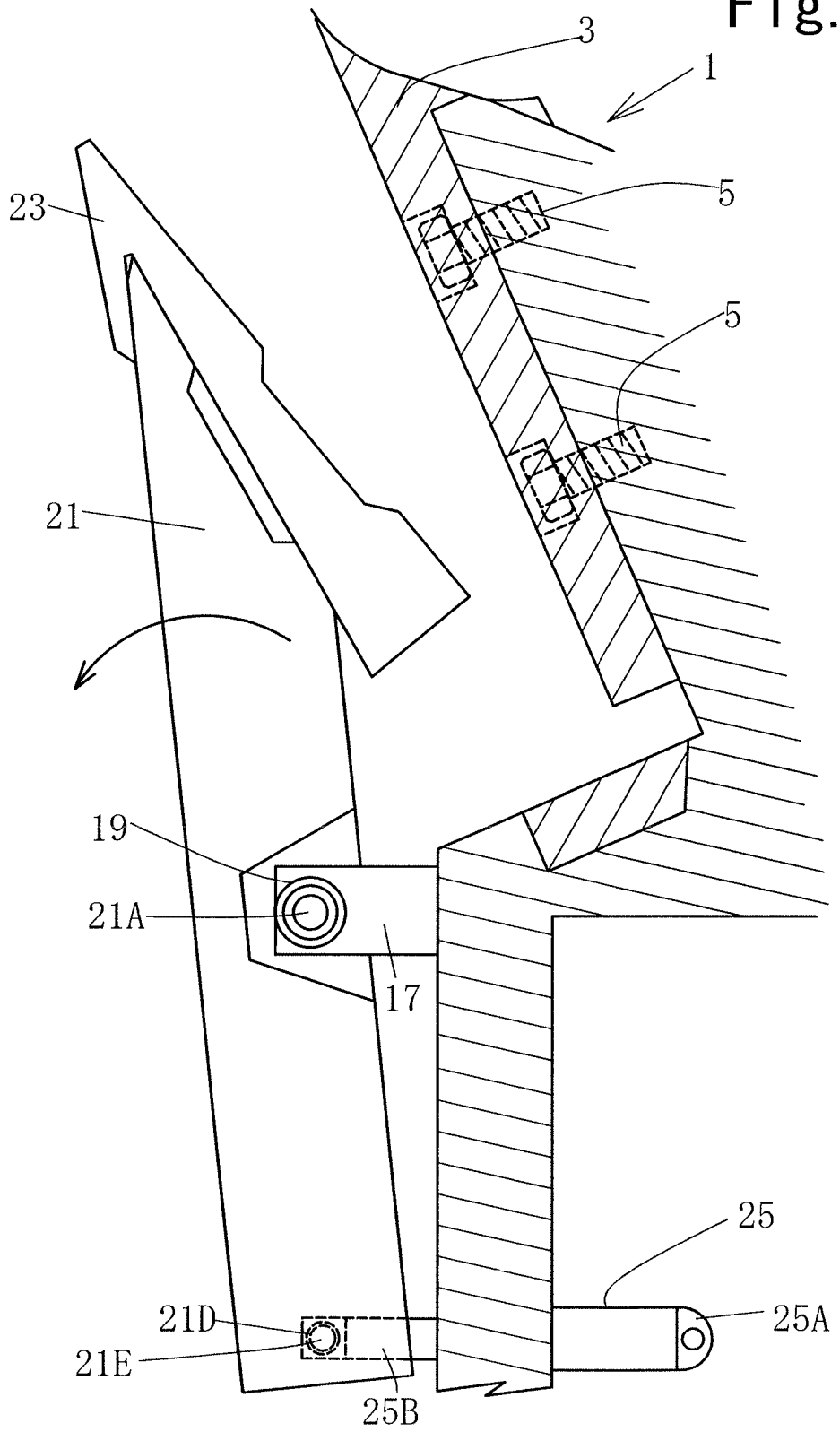
FIG. 4 is a fragmentary partially-sectional side view showing a part of a knife carriage in which a knife clamp is placed in its retracted position away from a blade back support plate.
Figure 5:
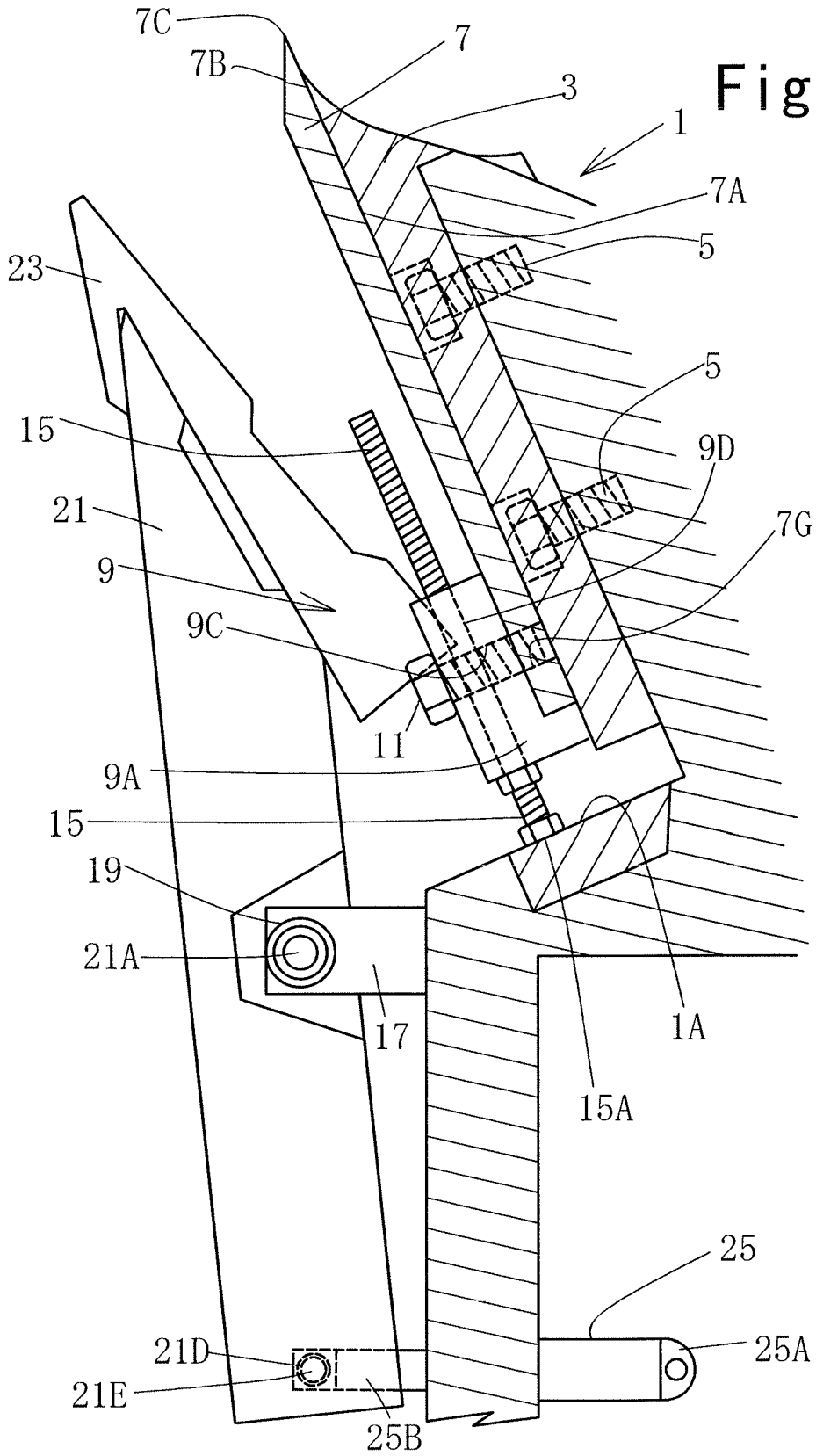
FIG. 5 is a fragmentary partially-sectional side view similar to FIG. 4, showing a state in which the knife assembly is set between the knife clamp and the blade back support plate in the knife carriage.

The following will describe procedures for mounting and removing the knife assembly P2 to and from the knife carriage 1. In mounting the knife assembly P2, all blade clamps 21, 23 are moved to their retracted inoperative position away from the blade back support plate 3, as shown in FIG. 4. The retraction may be accomplished by retracting the hydraulic cylinders 25 to pivot the blade clamps 21, 23 in counter-clockwise direction indicated by arrow in FIG. 4. Then, the lathe operator may insert the knife assembly P2 by manual work into a space then formed between the auxiliary blade clamps 23 and the blade back support plate 3 and sets the knife assembly P2 so that the head 15A of the adjusting bolt 15 is in contact with the mounting surface 1A and the second surface 7A of the knife blade 7 is in contact with the blade back support plate 3, respectively, as shown in FIG. 5. With the knife assembly P2 thus set in the knife carriage 1, the hydraulic cylinders 25 are operated to pivot the blade clamps 21, 23 in clockwise direction in FIG. 5 to move the blade clamps 21, 23 to the position shown in FIG. 3 so that the blade clamps 21, 23 hold down the knife assembly P2 firmly against the blade back support plate 3 thereby to fix the knife assembly P2 to the knife carriage 1, as shown in FIG. 3.

Figure 11:
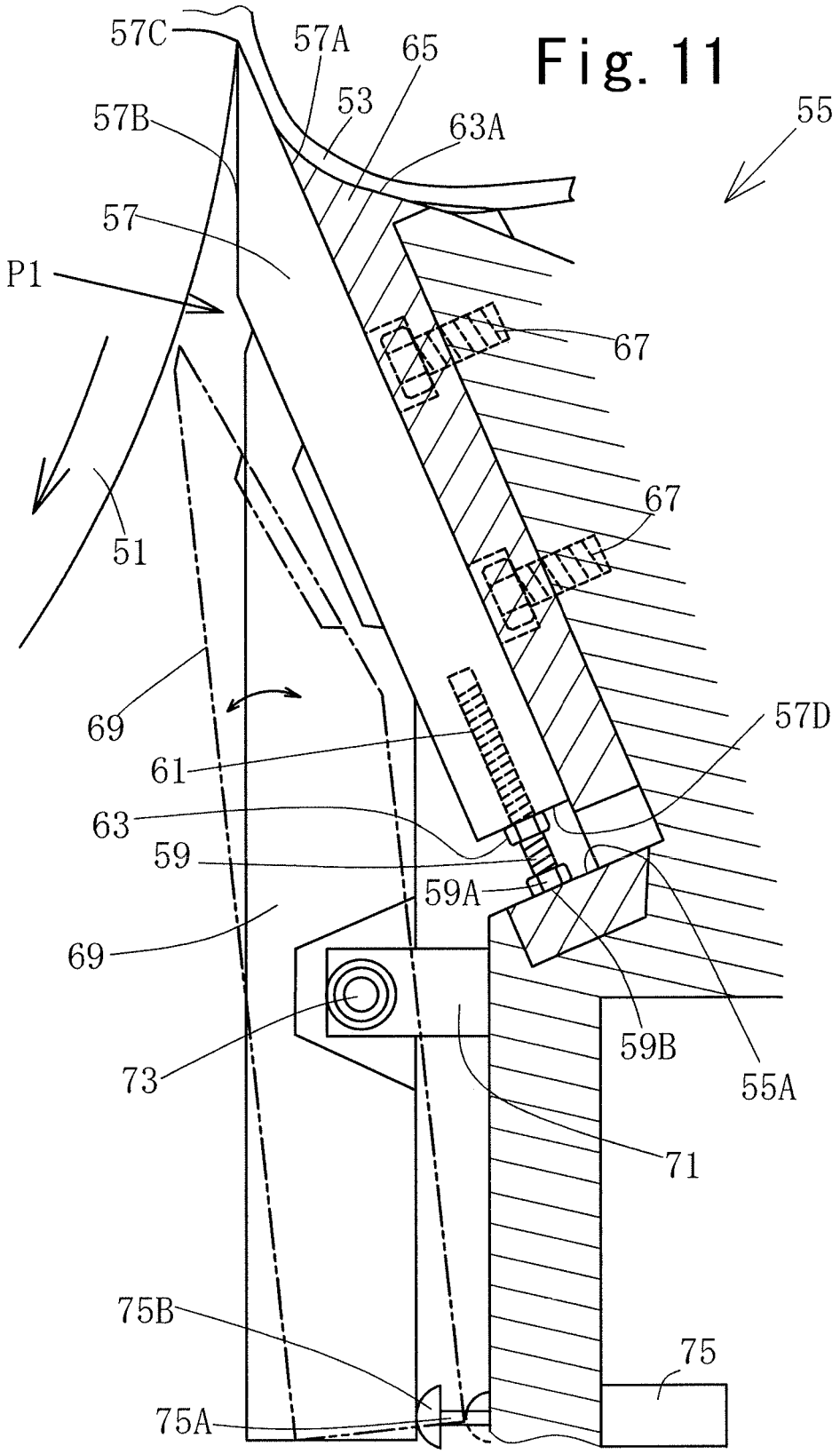
FIG. 11 is a fragmentary partially-sectional side view showing a conventional knife assembly for use in a rotary veneer lathe.

The knife assembly P2 set in the knife carriage 1 is used for peeling veneer from a wood block as described earlier with reference to FIGS. 11 and 12. When the cutting edge 7C of the knife blade 7 is worn to such an extent that the knife blade 37 need be reground, the knife assembly P2 is removed from the knife carriage 1. In removing the knife assembly P2, the hydraulic cylinders 25 are operated to move the blade clamps 21, 23 away from the blade back support plate 3 by retracting the hydraulic cylinders 25 to the position shown in FIG. 6.

Figure 6:
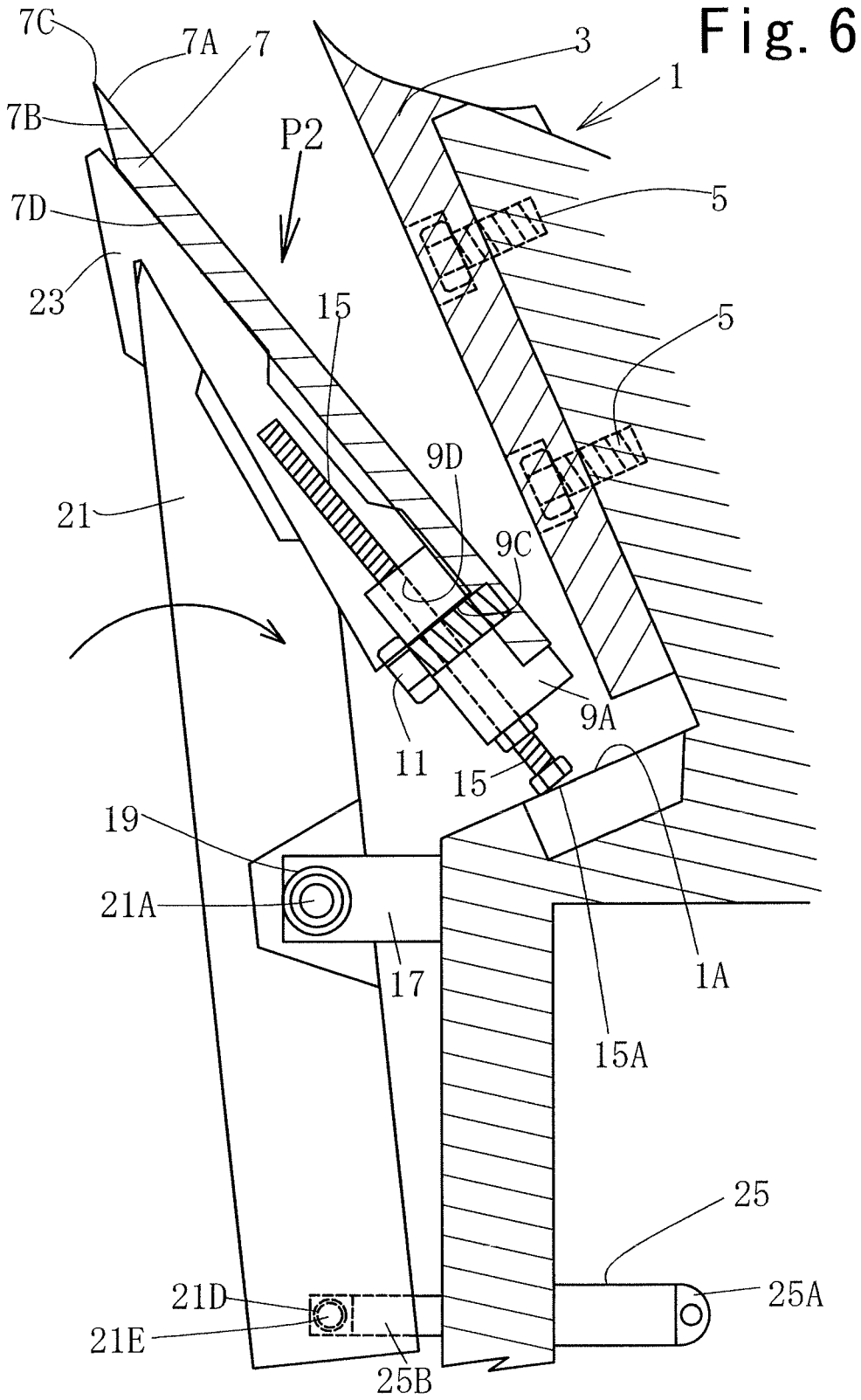
FIG. 6 is a fragmentary partially-sectional side view similar to FIG. 5, showing a state in which the knife clamp is moved with the knife assembly away from the blade back support plate.

As the blade clamps 21, 23 are retracted to the inoperative position, the knife assembly P2 is turned by its own weight with the blade clamps 21, 23 about the adjusting bolt head 15A to the position shown in FIG. 6. The lathe operator or maintenance personnel may remove manually the knife assembly P2 from the knife carriage 1 for regrinding of the knife blade 7. After the regrinding and the subsequent knife height adjustment are over, the knife assembly P2 is ready to be mounted on the knife carriage 1. As apparent from the foregoing description, the knife assembly P2 according to the above-described embodiment may be made lighter in weight than heretofore, so that removing and mounting of the knife assembly P2 from and to the knife carriage 1 may be accomplished with ease and less time.

The second embodiment of a knife assembly according to the present invention will now be described with reference to FIGS. 7 through 10. Coordinate axes L, H and T appear in FIGS. 7, 8 and 9, wherein L represents the longitudinal direction, H the height direction and T the thickness direction of the knife blade 37, respectively.

Figure 7:
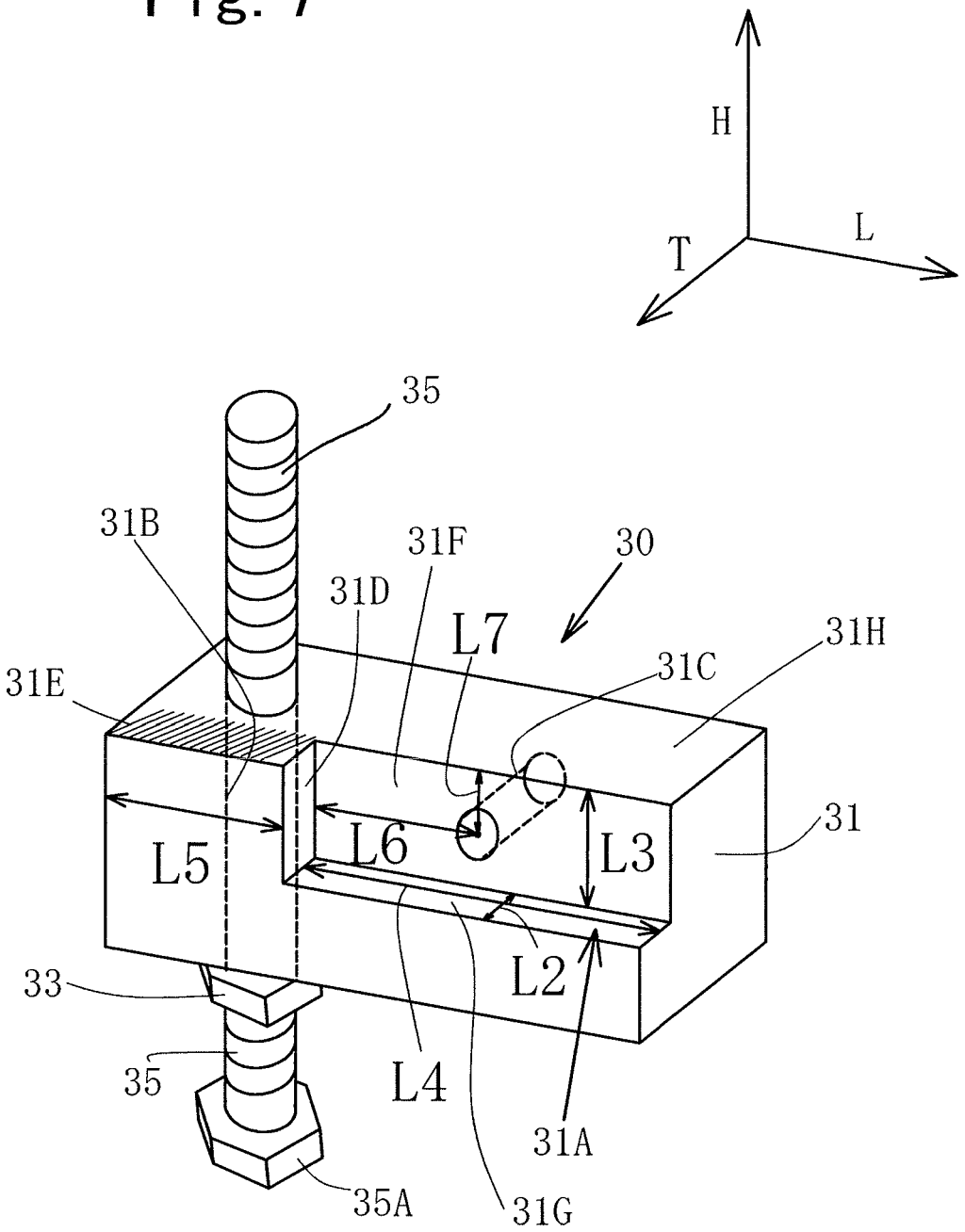
FIG. 7 is a perspective view showing a knife blade holder and a knife height adjusting bolt of a knife assembly according to a second embodiment of the present invention.
Figure 8:
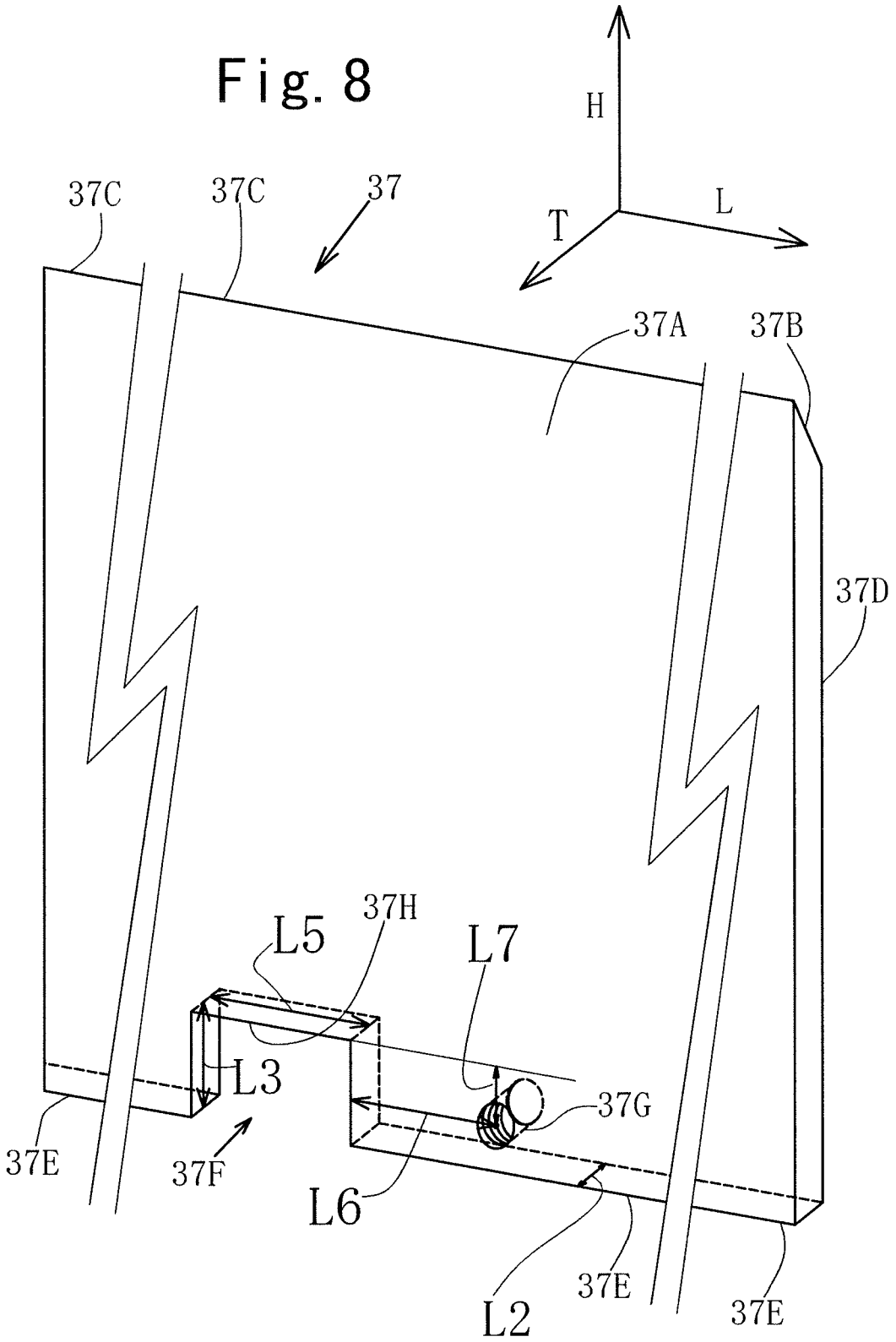
FIG. 8 is a fragmentary perspective view showing a knife blade of the knife assembly of the second embodiment.

Referring firstly to FIG. 7, there is shown in perspective view a knife blade holder 30 for a knife assembly P3 (FIGS. 9 and 10) of the second embodiment. The knife blade holder 30 includes a holder block 31 having therein a cutout void portion and a bolt adjusting bolt 35. Specifically, the holder block 31 is generally of a cuboid shape having formed therein a cutout void portion in the form of a recess 31A having three adjoining surfaces 31D, 31F and 31G. The surface 31F has a height L3 and a length L4 and extends parallel to the first surface 37D of the knife blade 37 when the holder block 31 and the knife blade 37 are assembled together into the knife assembly P3 shown in FIG. 9. Similarly, the surface 31G has a depth L2 and a length L4 and extends parallel to the base end surface 37E of the knife blade 37. The surface 31D has a depth L2 and a height L3 and extends perpendicularly to the surfaces 31F and 31G. As shown in FIG. 8, L2 corresponds to the thickness dimension of the knife blade 37. The holder block 31 has a top surface 31G having a surface area 31E that is indicated by shading and will be described later.

The holder block 31 of the knife blade holder 30 has formed therethrough two holes, namely a threaded hole 31B extending in height direction H and a hole 31C extending in thickness direction T, respectively. Specifically, the threaded hole 31B, which corresponds to the threaded hole 9D in the first embodiment, is formed through the holder block 31 in height direction H. The hole 31C, which corresponds to the hole 9C in the first embodiment, is formed extending through the block holder 31 in thickness direction T and has one end thereof opened through the surface 31F of the recess 31A at a position spaced from the surface 31D at a distance L6 and from the top surface 31H of the holder block 31 at a distance L7. The adjusting bolt 35, which corresponds to the adjusting bolt 15 in the first embodiment, is inserted and screwed through the threaded hole 31B from the bottom side thereof. The adjusting bolt 35 has a lock nut 33.

Additionally, the holder block 31 has a solid portion adjoining to the void portion or the cuboid-shaped recess 31A in longitudinal direction of the knife blade 37 and having a depth L2, a height L3 and a length L5. The surface area 31E in the top surface 31H of the holder block 31 forms the top surface of the solid portion. The surface area 31E is formed extending parallel to and spaced in the axial direction of the adjusting bolt 35 from the surface 31G.

Such holder block 31 of the knife blade holder 30 may be made, for example, by preparing a workpiece having a cuboid shape and made of a hard material such as steel and removing or cutting a part from the block stock, which part includes one vertex of the cuboid shape of the workpiece. As with the first embodiment, the knife assembly P3 of the second embodiment includes a plurality of the above-described knife blade holders 30.

Figure 9:
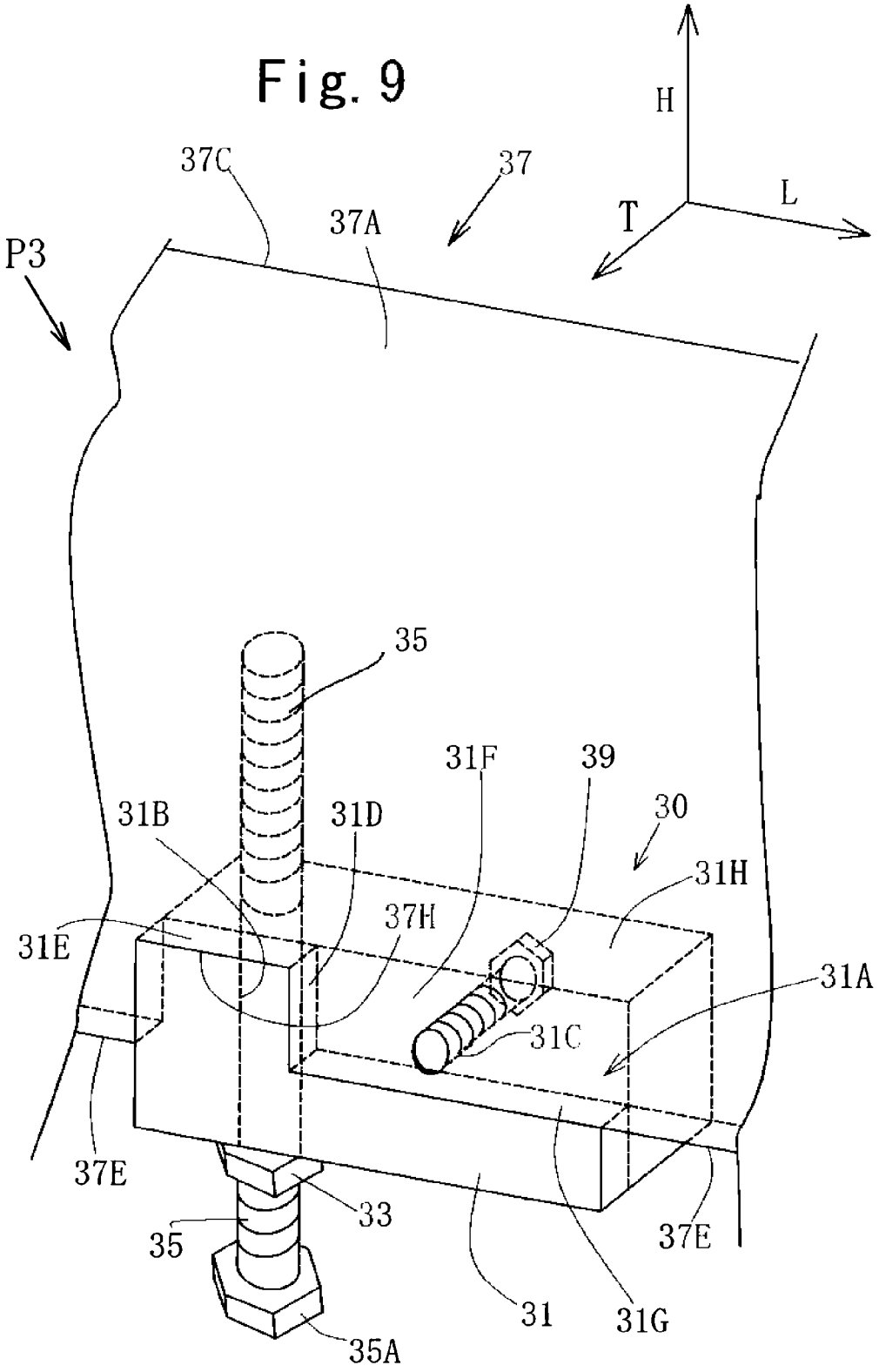
FIG. 9 is a fragmentary perspective view showing a state in which the knife blade holder is fixed to the knife blade in the knife assembly of the second embodiment.
Figure 10:
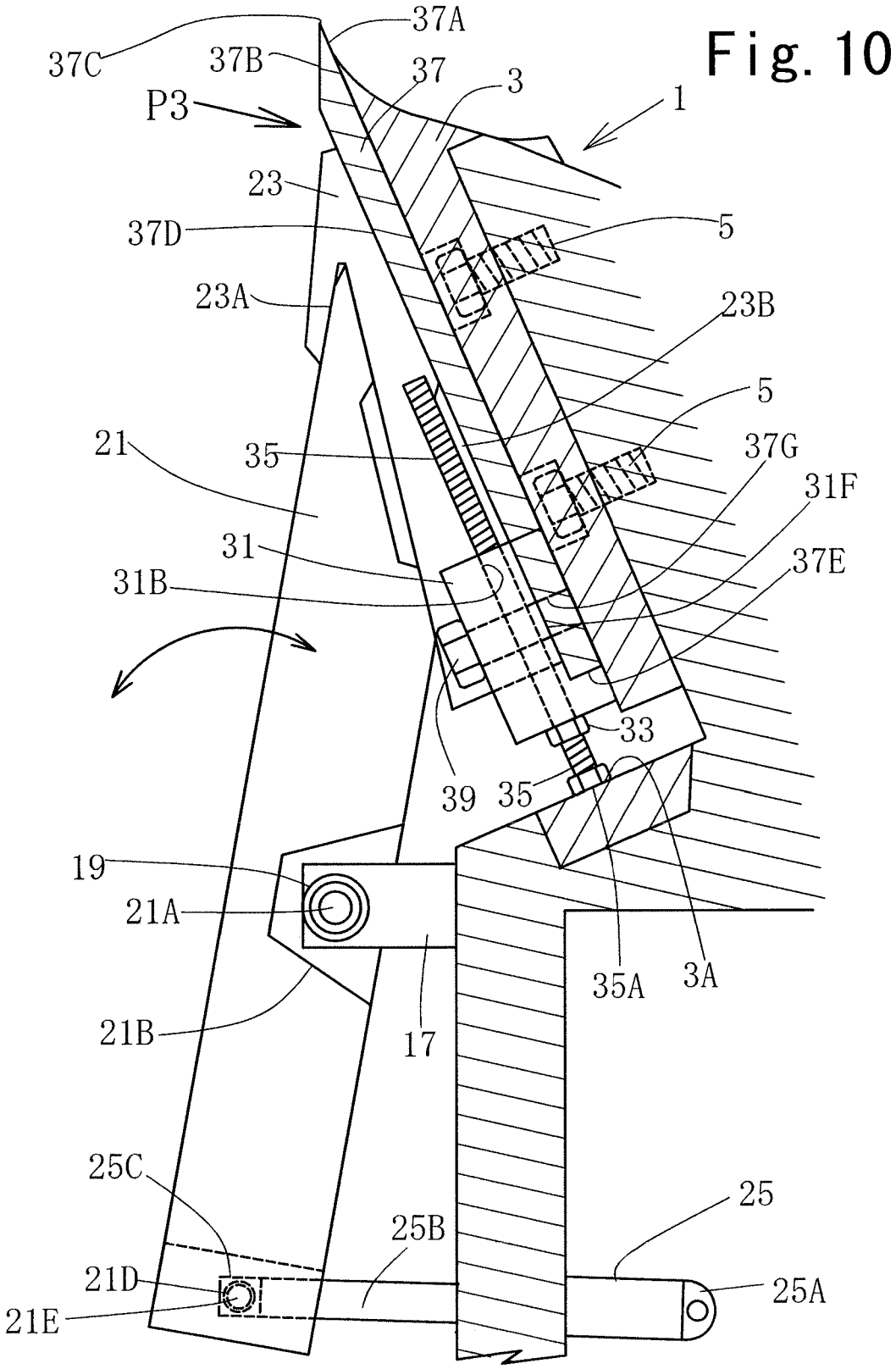
FIG. 10 is a fragmentary partially-sectional side view showing the knife assembly of the second embodiment as mounted in a knife carriage.

Referring to FIG. 8, there is shown in perspective view the knife blade 37 of the knife assembly P3 of the second embodiment. As with the knife blade 7 of the first embodiment, the knife blade 37 has a first surface 37D, a second surface 37A, a bevel surface 37B, a cutting edge 37C, and a base end surface 37E. The knife blade 37 has formed in the bottom thereof a plurality of cutout rectangular recesses 37F (only one recess shown in FIG. 8) each recessed from the base end surface 37E toward the cutting edge 37C and having a bottom surface 37H that forms a part of the base end surface 37E with a length L5. As shown in FIG. 8, the base end surface 37E has a length L5 and two opposite surfaces having a height L3. Thus, the rectangular recess 37F of the knife blade 37 is configured to have a shape that is complementary to that of the aforementioned solid portion of the holder block 31 so that the solid portion is received in the recess 37F of the knife blade 37, as shown in FIG. 9. To be accurate, the size of dimension of the rectangular recess 37F is just slightly larger than that of the solid complementary portion of the holder block 31 so that the holder block 31 is received snugly and fitted in the rectangular recesses 37F.

As shown in FIG. 8, the knife blade 37 has formed therethrough a threaded hole 37G, which corresponds to the threaded hole 9D in the first embodiment. The threaded hole 37G is formed extending in thickness direction T at a position that is spaced from the right-side surface of the rectangular recess 37F as seen in FIG. 8 at the distance L6 and from an imaginary plane passing through the bottom surface 37H at the distance L7 so that the threaded hole 37G and the hole 31C of the knife blade 37 are positioned coaxially when the holder block 31 is fixed to the knife blade 37.

Referring to FIG. 9 showing the knife assembly P3, the knife blade holder 30 having the adjusting bolt 35 screwed through the threaded hole 31B in the holder block 31 is fitted and fixed in the rectangular recesses 37F of the knife blade 37 with the surface 31F of the holder block 31 in contact with a part of the first surface 37D of the knife blade 37 and with the surface area 31E of the holder block 31 (indicated by shading in FIG. 7) in contact with the bottom surface 37H in the rectangular recess 37F of the knife blade 37, or alternatively with the surface 31G in the recess 31A of the holder block 31 in contact with the a part of the base end surface 37E of the knife blade 37. As shown in FIGS. 7 through 10, the surfaces 31F and 31G in the recess 31A and the top surface 31H including the surface area 31E of the holder block 31 and the base end surface 37E including the bottom surface 37H of the knife blade 37 are formed flat, so that the above contacts are provided by surface-to-surface contact. With the holder block 31 mounted to the knife blade 37 as shown in FIG. 9, the hole 31C in the holder block 31 is aligned with the threaded hole 37G in the knife blade 37. The knife holder 30 may be fixed to the knife blade 37 by the fixing bolt 39 inserted through the hole 31C in the holder block 31 and screwed tight in the threaded hole 37G in the knife blade 37, as shown in FIG. 9. The fixing bolt 39 has such a length that no part of the end of the fixing bolt 39 opposite from the bolt head projects out of the threaded hole 37G of the knife blade 37 when the fixing bolt 39 is tightened. The adjusting bolt 35 screwed through the threaded hole 31B may be secured by the lock nut 33.

As is apparent from the foregoing description, the surface 31F of the recess 31A of the holder block 30 serves as the first support surface and the surface area 31 of the holder block 31 as the second support surface of the present invention, respectively. As indicated above, the surface 31G of the recess 31A of the holder block 31 serves as alternative second support surface of the present invention.

Figure 12:
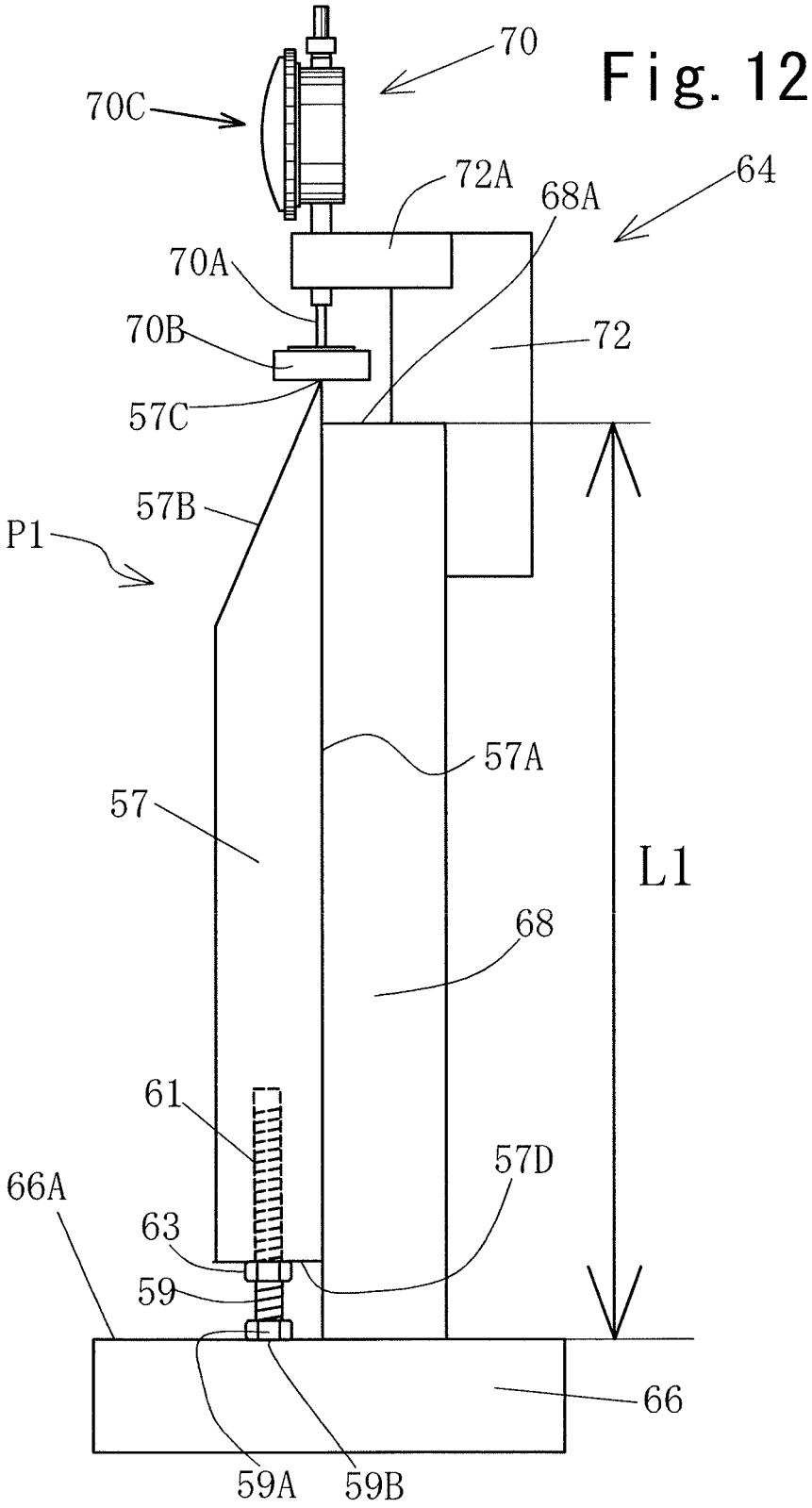
FIG. 12 is a schematic diagram illustrating a method of knife height adjustment of the knife assembly of FIG. 11.

In this knife assembly P3, the knife height adjustment to determine the dimension L1 (FIG. 1) between the cutting edge 37C of knife blade 37 and the top surface of the adjusting bolt head is made in the same manner as described with reference to FIG. 12. After the knife height adjustment is over, the adjusting bolt 35 may be fixed securely by tightening the lock nut 33. The knife assembly P3 having the knife height adjusted properly is mounted to the knife carriage 1 of the veneer lathe in the same manner as with the knife assembly P2 of the first embodiment. When the cutting edge 37C of the knife blade 37 is worn calling for regrinding, the knife assembly P3 is removed from the knife carriage 1 for regrinding and a knife assembly such as P3 having a reground knife blade such as 37 is adjusted for the knife height and mounted to the knife carriage 1 of the veneer lathe.

In the knife assembly P3 according to the second embodiment in which the threaded hole 31B for the adjusting bolt 35 is formed through the holder block 31 at a position that is spaced away from the cutout recess 31A in the longitudinal direction L, the threaded hole 31B may be located close to the support surface 31F and hence to the first blade surface 37D. Therefore, the distance between the knife blade 37 and the adjusting bolt 35 in the knife assembly P3 is reduced in comparison with the knife assembly P2 of the first embodiment, as is apparent from comparison of FIGS. 10 and 3. This reduction of the distance helps to reduce the moment that is created due to the force applied to the knife blade 37 during veneer cutting and acts on the knife blade 37 in clockwise direction in FIG. 10.

It is to be noted that the present invention is not limited to the above-described embodiments, but it may be practiced in various ways as exemplified below.

In the foregoing embodiments, the holder block 9A, 31 and the knife blade 7, 37 are fixed together through surface-to-surface contact between the knife blade 7, 37 and the holder block 9A, 13. According to the present invention, however, the support surfaces of the holder block and the base end surface of the knife blade need not be formed flat, but may be formed, for example, with a plurality of projections so that the contact between the knife blade and the holder block of the knife holder may provided by point-to-surface contact.

In the first and the second embodiments, the threaded holes 7G, 37G are formed through the knife blades 7, 37, respectively. According to the present invention, however, the threaded holes need not necessarily be formed through the entire thickness of the knife blade as long as the holder block may be fixed to the knife blade with an appropriate strength.

Additionally, in making the knife assembly P2, P3, the holder block 7A, 31 need not necessarily be fixed to the knife blade by means of fixing bolts. According to the present invention, however, the fixing of the holder block to the knife blade may be accomplished by means of adhesive or welding.

The adjusting bolts 15, 35 in the first and the second embodiments are secured by means of the lock nuts 13, 33, respectively, to prevent loosening of the adjusting bolts. Alternatively, the adjusting bolt may be secured by using double-nut arrangement.

In the above-described embodiments, it is so arranged that the end of the fixing bolts 11, 39 opposite from the heads does not project beyond the second blade surface 7A, 37A of the knife blade 7, 37. According to the present invention, however, the end of the fixing bolt may project slightly from the second surface of the knife blade as long as the knife assembly P2, P3 may be fixed securely to knife carriage 1 without any inconvenience.

What is claimed is:

1. A knife assembly comprising, a single cutting edge consisting of a single knife blade having a thickness, first and second blade surfaces across the thickness, a bevel surface formed on the first blade surface side of the single knife blade, a cutting edge formed by the second blade surface and the bevel surface, a base end surface located opposite from and extending parallel to the cutting edge, a plurality of knife blade holders including respective holder blocks each having a first support surface configured to contact with a part of the first blade surface of the single knife blade and a second support surface configured to contact with a part of the base end surface of the single knife blade, each holder block having therethrough a threaded first hole formed extending in a direction perpendicular to the second support surface of the holder block, the holder block being removably fixed to the single knife blade, said plurality of knife blade holders being disposed with predetermined intervals therebetween relative to and in a longitudinal direction of the single cutting edge of the single knife blade, a knife adjusting bolt adjustably inserted through each threaded first hole, a lock nut that releasably fixes each knife adjusting bolt to each holder block; and wherein the knife blade has therein a plurality of cuboid recesses aligning parallel to the cutting edge at predetermined intervals therebetween, each cuboid recess being recessed from the base end surface toward the cutting edge and having a surface extending parallel to the cutting edge and forming part of the base end surface of the knife blade, whereas said holder block of each knife blade holder has a cuboid shape formed with a complementary portion including a cuboid void portion to receive part of said knife blade and a cuboid solid portion adjoining said cuboid void portion, said cuboid solid portion being sized to fit in each cuboid recess in said knife blade, said cuboid solid portion providing the second support surface to support the knife blade at said surface in the cuboid recess thereof.

2. The knife assembly according to claim 1, wherein the knife blade has therein at a position adjacent to the base end surface thereof a plurality of threaded holes each formed extending in the thickness direction of the knife blade while each holder block of each knife blade holder has therethrough a clearance hole formed coaxially with the corresponding threaded hole in the knife blade, each knife blade holder further including a fixing bolt that is inserted through the clearance hole in each holder block and screwed in the corresponding threaded hole in the knife blade to fix each holder block of the knife blade holder to the knife blade.

3. The knife assembly according to claim 1, wherein each holder block of each knife blade holder is of an L-shape having a vertical portion and a horizontal portion in cross section taken perpendicularly to the first and the second support surfaces of each holder block and has the first support surface and the second support surface in the vertical portion and the horizontal portion of the L-shape of each holder block, respectively.

4. The knife assembly according to claim 1, wherein said knife blade has therein the plurality of cuboid recesses aligning parallel to the cutting edge at predetermined intervals therebetween, each cuboid recess being recessed from the base end surface toward the cutting edge and having a surface extending parallel to the cutting edge and forming part of the base end surface of the knife blade, whereas said holder block of each knife blade holder has a cuboid shape formed with a complementary portion including the cuboid void portion to receive part of said knife blade and the cuboid solid portion adjoining said cuboid void portion, said cuboid solid portion being sized to fit in one of said cuboid recesses in said knife blade, said cuboid void portion in the holder block providing the second support surface to support the knife blade at said base end surface of the knife blade.

5. The knife assembly according to claim 3, wherein the first support surface of each holder block is formed flat.

6. The knife assembly according to claim 3, wherein the second support surface of each holder block is formed flat.

7. The knife assembly according to claim 3, wherein the base end surface of the knife blade is formed flat.

8. The knife assembly according to claim 2, wherein each holder block of each knife blade holder is of an L-shape having a vertical portion and a horizontal portion in cross section taken perpendicularly to the first and the second support surfaces of each holder block and has the first support surface and the second support surface in the vertical portion and the horizontal portion of the L-shape of each holder block, respectively.

9. The knife assembly according to claim 2, wherein the knife blade has therein the plurality of cuboid recesses that is recessed from the base end surface toward the cutting edge and has a surface extending parallel to the cutting edge and forming the part of the base end surface of the knife blade, each holder block has a shape of a cuboid shape as a part thereof, which includes one vertex of the cuboid shape, removed therefrom thereby to form the cuboid void portion in each holder block, the cuboid void portion being in the form of the cuboid void portion in each holder block having three adjoining recessed surfaces including a surface extending parallel to the first blade surface and forming the first support surface that is in contact with the part of the first blade surface and a surface extending parallel to the base end surface and having a dimension as measured in the knife blade thickness direction corresponding to the thickness of the knife blade, each holder block having the cuboid solid portion in each holder block adjoining to the cuboid-shaped recess in the direction along the cutting edge of the knife blade, the solid portion having a shape that is complementary to that of the plurality of cuboid recesses formed in the knife blade and a surface extending parallel to and spaced in an axial direction of each knife adjusting bolt from the surface of the cuboid-shaped recess extending parallel to the base end surface at a position of each holder block that is downstream of the adjusting bolt with respect to a direction in which the fixing bolt is advanced when screwed in a fixing direction in the threaded holes of the knife blade, the surface of the solid complementary portion having the same size in the knife blade thickness direction as the surface of the cuboid-shaped recess extending parallel to the base end surface and forming the second support surface that is in contact with the surface in the plurality of cuboid recesses formed in the knife blade, and each holder block being fixed to the knife blade with the complementary portion of each holder block inserted in the plurality of cuboid recesses of the knife blade.

10. The knife assembly according to claim 2, wherein the knife blade has therein the plurality of cuboid recesses that is recessed from the base end surface toward the cutting edge and has a surface extending parallel to the cutting edge, each holder block has a shape of a cuboid shape as a part thereof, which includes one vertex of the cuboid shape, removed therefrom thereby to form the cuboid void portion in each holder block, the void portion being in the form of a cuboid void portion in each holder block that has three adjoining recessed surfaces including a surface extending parallel to the first blade surface and forming the first support surface that is in contact with the part of the first blade surface and a surface extending parallel to the base end surface, having a dimension as measured in the knife blade thickness direction corresponding to the thickness of the knife blade and forming the second support surface that is in contact with the part of the base end surface, each holder block having a cuboid solid portion in each holder block adjoining to the cuboid-shaped recess in the direction along the cutting edge of the knife blade, the solid portion having a shape that is complementary to that of the plurality of cuboid recesses formed in the knife blade and a surface extending parallel to and spaced in an axial direction of each knife adjusting bolt from the surface of the cuboid void portion in each holder block extending parallel to the base end surface at a position of each holder block that is downstream of the adjusting bolt with respect to a direction in which the fixing bolt is advanced when screwed in a fixing direction in the threaded holes of the knife blade, the surface of the solid complementary portion having the same size in the knife blade thickness direction as the surface of the cuboid void portion in each holder block extending parallel to the base end surface, each holder block being fixed to the knife blade with the complementary portion of each holder block inserted in the plurality of cuboid recesses of the knife blade.

11. The knife assembly according to claim 1, wherein the first support surface of each holder block is formed flat.

12. The knife assembly according to claim 4, wherein the first support surface of each holder block is formed flat.

13. The knife assembly according to claim 8, wherein the first support surface of each holder block is formed flat.

14. The knife assembly according to claim 1, wherein the second support surface of each holder block is formed flat.

15. The knife assembly according to claim 4, wherein the second support surface of each holder block is formed flat.

16. The knife assembly according to claim 8, wherein the second support surface of each holder block is formed flat.

17. The knife assembly according to claim 1, wherein the base end surface of the knife blade is formed flat.

18. The knife assembly according to claim 4, wherein the base end surface of the knife blade is formed flat.

19. The knife assembly according to claim 8, wherein the base end surface of the knife blade is formed flat.

* * * * *